US009644522B2

(12) United States Patent
Gudorf et al.

(10) Patent No.: US 9,644,522 B2
(45) Date of Patent: May 9, 2017

(54) CAST END CAP MOUNTING MODULE

(75) Inventors: Kevin Virgil Gudorf, Columbus, IN (US); Jerome Brian Hornback, Greenwood, IN (US)

(73) Assignee: Faurecia Emission Control Technologies, USA, LLC, Columbus, IN (US)

( * ) Notice: Subject to any disclaimer, the term of this patent is extended or adjusted under 35 U.S.C. 154(b) by 2577 days.

(21) Appl. No.: 12/049,441

(22) Filed: Mar. 17, 2008

(65) Prior Publication Data

US 2009/0232592 A1 Sep. 17, 2009

(51) Int. Cl.

| | |
|---|---|
| ***F01N 13/08*** | (2010.01) |
| ***F01N 13/00*** | (2010.01) |
| ***F01N 3/28*** | (2006.01) |
| ***F01N 13/16*** | (2010.01) |

(52) U.S. Cl.

CPC ..... *F01N 13/008* (2013.01); *F01N 3/2839* (2013.01); *F01N 13/08* (2013.01); *F01N 13/16* (2013.01); *Y10T 403/473* (2015.01); *Y10T 403/478* (2015.01)

(58) Field of Classification Search

CPC ..... F01N 13/008; F01N 13/08
USPC ..... 285/129.1, 129.2, 130.1, 131.1, 133.11, 285/197, 285.1; 60/302
See application file for complete search history.

(56) References Cited

U.S. PATENT DOCUMENTS

| | | | | | |
|---|---|---|---|---|---|
| 622,326 | A * | 4/1899 | Burnett | 285/129.1 | |
| 749,309 | A * | 1/1904 | Madden | 4/351 | |
| 770,539 | A * | 9/1904 | Ryan | 4/211 | |
| 860,050 | A * | 7/1907 | Mouat | 4/211 | |
| 917,395 | A * | 4/1909 | Wise | 4/680 | |
| 924,839 | A * | 6/1909 | Schmidt | 285/129.2 | |
| 954,604 | A * | 4/1910 | Young | 285/129.2 | |
| 991,142 | A * | 5/1911 | Erck | 285/129.1 | |
| 1,362,718 | A * | 12/1920 | McNamara | 285/129.2 | |
| 1,561,436 | A * | 11/1925 | Smith | E03C 1/122 285/129.1 | |
| 1,759,321 | A * | 5/1930 | Oldfield | 285/125.1 | |
| 2,611,631 | A * | 9/1952 | Benson | 285/197 | |
| 3,921,273 | A * | 11/1975 | Kondo | F01N 3/26 29/890.06 | |
| 4,073,018 | A * | 2/1978 | Arrowood | 4/696 | |
| 4,151,717 | A * | 5/1979 | Katsumoto | F01N 13/10 60/302 | |
| 4,709,947 | A * | 12/1987 | Kniess | 285/131.1 | |
| 5,104,152 | A * | 4/1992 | Galfant | 285/47 | |
| 5,271,477 | A * | 12/1993 | Gekka | F01N 13/08 60/302 | |
| 6,409,220 | B1 * | 6/2002 | Wing et al. | 285/12 | |

(Continued)

FOREIGN PATENT DOCUMENTS

| | | |
|---|---|---|
| JP | 57210117 | 12/1982 |
| JP | 1124033 | 8/1989 |

(Continued)

*Primary Examiner* — David E Bochna

(74) *Attorney, Agent, or Firm* — Carlson, Gaskey & Olds, PC

(57) ABSTRACT

An end cap mounting module comprises an end cap body that is cast as a single-piece component that has a first mount interface for connection to a catalytic converter and a second mount interface for connection to an exhaust pipe. The single-piece end cap body can include at least one integrally formed sensor boss and/or fastener boss.

34 Claims, 2 Drawing Sheets

(56) References Cited

U.S. PATENT DOCUMENTS

| | | | | |
|---|---|---|---|---|
| 8,240,128 | B2 * | 8/2012 | Albright, Jr. | F01N 13/008 60/302 |
| 8,297,048 | B2 * | 10/2012 | Biedler | F01N 3/28 60/302 |
| 2007/0119156 | A1 * | 5/2007 | Hill, Jr. | F01N 3/2853 60/302 |
| 2015/0300233 | A1 * | 10/2015 | Bowers | F01N 13/008 60/320 |
| 2016/0061089 | A1 * | 3/2016 | Shimoji | F01N 13/008 60/323 |

FOREIGN PATENT DOCUMENTS

| | | | | |
|---|---|---|---|---|
| JP | 1991-43527 U | 9/1989 | | |
| JP | 2000265830 | 9/2000 | | |
| JP | 2002161741 | 6/2001 | | |
| JP | 2007016636 | 1/2007 | | |
| JP | 2007092669 | 4/2007 | | |
| JP | WO 2010004805 A1 * | 1/2010 | | F01N 13/008 |
| JP | WO 2010018722 A1 * | 2/2010 | | F01N 13/008 |
| JP | WO 2011114857 A1 * | 9/2011 | | F01N 13/008 |
| JP | WO 2014103944 A1 * | 7/2014 | | F01N 13/008 |

* cited by examiner

CAST END CAP MOUNTING MODULE

TECHNICAL FIELD

The subject invention relates to an end cap mounting module, and more particularly relates to an end cap mounting module that is cast as a single-piece component.

BACKGROUND OF THE INVENTION

Exhaust systems are widely known and used with combustion engines. An exhaust system includes exhaust tubes that convey hot exhaust gases from the engine to other exhaust system components, such as catalytic converters, mufflers, resonators, etc. As known, the catalytic converter houses a catalyst through which the exhaust gas and excess air are passed so that carbon monoxide and hydrocarbon pollutants are oxidized to carbon dioxide and water.

An end cap mounting module is mounted to one end of the catalytic converter. The end cap mounting module includes an outlet to an exhaust pipe. Typically, the end cap mounting module includes a sensor boss and mounting structure such that the end cap mounting module can be mounted to a vehicle structure. Traditionally, the end cap mounting module has been formed from stamped metal sheet portions that are welded together. The sensor boss is a separate piece that is welded to an outer surface of the end cap mounting module. The sensor boss comprises an elongated body that extends outwardly from the outer surface by a sufficient length such that there is adequate room to perform the welding operation to attach the sensor boss to the end cap mounting module. The mounting structure has also traditionally comprised separate mounting brackets or mounting supports that are welded to the outer surface of the end cap mounting module.

During operation, high load forces into the catalytic converter and end cap mounting module place significant stress levels on weld joint interfaces, especially those interfaces for the mounting structure. These stress levels can cause cracking at the weld joint interfaces, which adversely affects the durability of the part and can lead to premature failure.

Further, the mounting structure and sensor boss portions are larger than they need to be in order to accommodate the welding operations for their respective attachment to the end cap mounting module. As such, the traditional configuration takes up a significant amount of the packaging space available for the exhaust system.

Another disadvantage with traditional configurations concerns debris collection. Bolts and other surfaces with flat angles in the stamped configuration form pinch points for collecting debris, which is undesirable.

Therefore, there is a need to provide an end cap mounting module that provides increased durability, eliminates pinch points for debris collection, and which is a more compact configuration such that packaging space can be freed up for other components. This invention addresses those needs while avoiding the shortcomings and drawbacks of the prior art.

SUMMARY OF THE INVENTION

An end cap mounting module includes an end cap body that is cast as a single-piece component. The single-piece component includes a first mount interface for connection to a catalytic converter and a second mount interface for connection to an exhaust pipe.

In one example, a single-piece end cap body is cast from a cast iron material.

In one example, the single-piece end cap body includes an integrally formed sensor boss that is cast as part of the single-piece component.

In one example, the single-piece end cap body includes at least one integrally formed fastener boss that is cast as part of the single-piece component.

In one example, the single-piece end cap body includes a continuous and uninterrupted surface that extends from the first mount interface to the second mount interface.

In one example, the first mount interface comprises a first opening defining a first center axis and the second mount interface comprises a second opening defining a second center axis that is perpendicular to the first center axis.

The single-piece cast end cap body provides a more durable and compact configuration that eliminates pinch points for debris collection. These and other features of the present invention can be best understood from the following specification and drawings, the following of which is a brief description.

DETAILED DESCRIPTION OF THE PREFERRED EMBODIMENT

Figure 1:
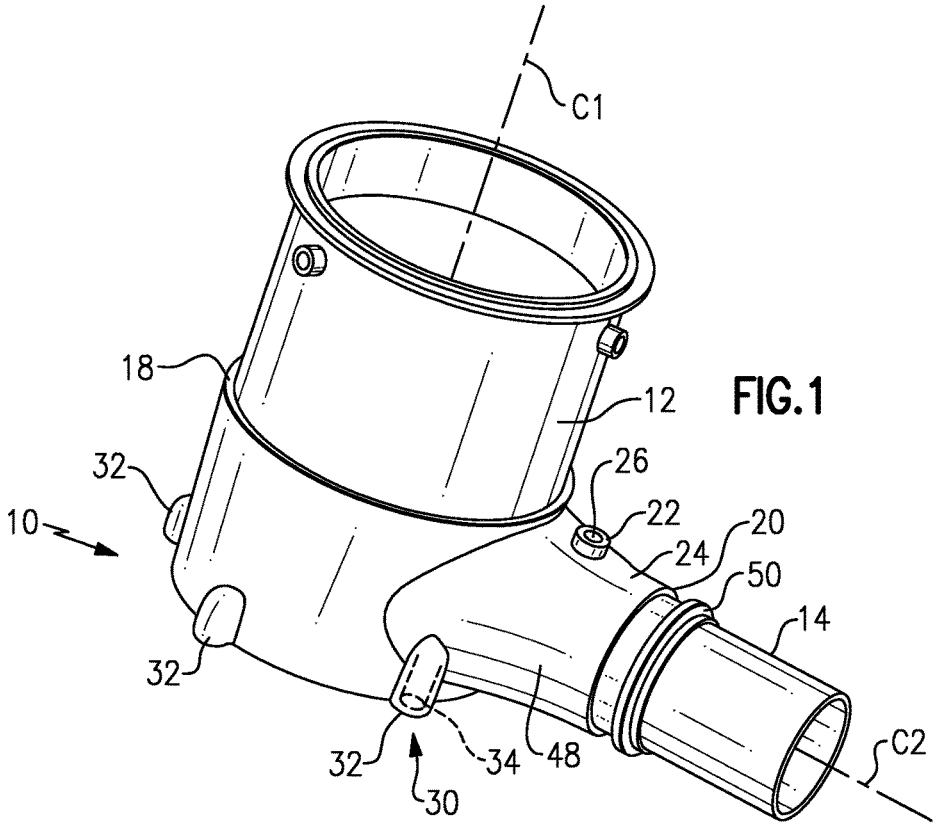
FIG. 1 is a perspective view of an end cap mounting module that is connected to a catalytic converter and an exhaust pipe.

As shown in FIG. 1, an end cap mounting module 10 is connected to a catalytic converter 12 and to an exhaust pipe 14. The catalytic converter 12 and exhaust pipe 14 can be connected to other exhaust system components as known. The operation of the catalytic converter 12 is well known and will not be discussed in detail.

Figure 2:
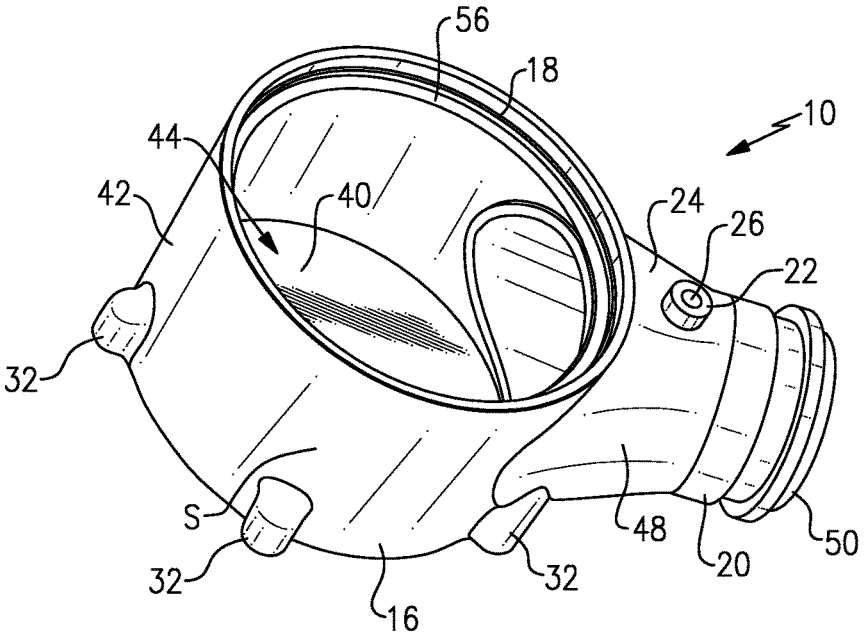
FIG. 2 is a perspective view of the end cap mounting module as viewed from a catalytic converter connection interface.

As shown in FIG. 2, the end cap mounting module 10 is formed as a single-piece cast component. As such, the end cap mounting module 10 comprises a single-piece end cap body 16 that has a first mount interface 18 for connection to the catalytic converter 12 and a second mount interface 20 for connection to the exhaust pipe 14. As the end cap mounting module 10 is a cast component, the single-piece end cap body 16 provides a continuous, uninterrupted surface S from the first mount interface 18 to the second mount interface 20. In other words, the single-piece end cap body 16 does not utilize any weld joint interfaces to form the body itself.

The single-piece end cap body 16 also includes an integrally cast sensor boss 22. The sensor boss 22 extends outwardly from an outer surface 24 of the single-piece end cap body 16 and includes an opening 26 into which a sensor (not shown) can be inserted. The opening 26 is machined into the part after casting.

The single-piece end cap body 16 also includes an integrally cast mount structure 30. In the example shown, the mount structure 30 comprises a plurality of discrete fastener bosses 32 that are spaced circumferentially about the single-piece end cap body 16. Each fastener boss 32 includes a threaded opening 34 to receive a fastener such that the end cap mounting module 10 can be secured to a vehicle structure. Again, by integrally casting the mount structure 30 as part of the single-piece end cap body 16, the overall packaging space required for the end cap mounting module 10 is reduced because the size of the mount structure can be reduced due to the elimination of a welding attachment operation.

As shown in FIG. 2, the single-piece end cap body 16 is comprised of a bowl shape that has a bottom portion 40 with a circumferential wall portion 42 extending outwardly about an outer periphery of the bottom portion 40. An inner cavity 44 is defined within the bowl portion and fluidly connects the first 18 and second 20 mount interfaces. The first mount interface 18 comprises a circular opening that connects directly to the catalytic converter 12. The circular opening defines a first center axis C1 (FIG. 1).

A tubular portion 48 extends outwardly from the circumferential wall portion 42. The sensor boss 22 is located on the tubular portion 48. The length of the tubular portion 48 is minimized compared to prior designs due to the elimination of a weld attachment interface, i.e. additional weld clearances are no longer required for attachment of the sensor boss 22 so that the length of the tubular portion 48 can be reduced. As such, the overall packaging space required for the end cap mounting module 10 is reduced.

The tubular portion 48 terminates at the second attachment interface 20. The second mount interface 20 comprises a circular opening that connects to the exhaust pipe 14. The second mount interface 20 can be directly connected to the exhaust pipe 14. Optionally, an integrated flange component 50, such as a marmon flange for example, can be used at the second mount interface 20 to connect the end cap mounting module 10 to the exhaust pipe 14. The circular opening of the second mount interface 20 defines a second center axis C2 (FIG. 1) that is perpendicular to the first center axis C1. As such, the end cap mounting module 10 provides for a right-angle or 90 degree orientation mount. This type of configuration is especially advantageous from a packaging perspective. However, a straight-line (180 degree) orientation, or other angle orientations could also be used as needed dependent upon the overall configuration of the specific exhaust system. Further, the end cap mounting module 10 can have other shapes and/or can have non-circular openings at the first and second attachment interfaces.

Optionally, a heat shield insert 56 can be mounted within the internal cavity 44. The heat shield insert 56 lowers outer skin temperatures for the end cap mounting module 10.

Figure 3:
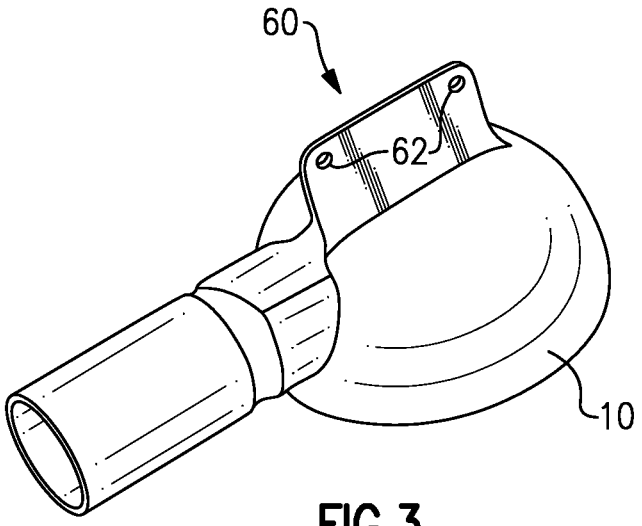
FIG. 3 shows another example of an end cap mounting module.
Figure 4:
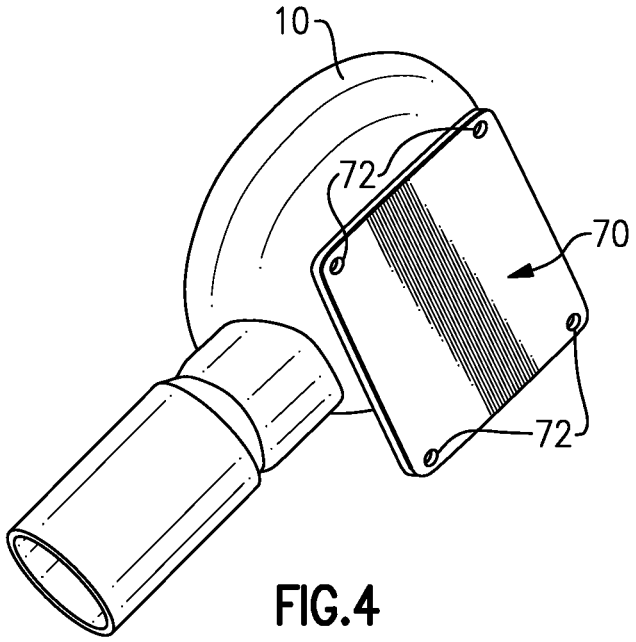
FIG. 4 shows another example of an end cap mounting module.

FIGS. 3-4 show other examples of integrally cast mounting structure. FIG. 3 shows a mounting structure 60 that comprises an integrally cast flange with threaded openings 62 to receive fasteners. FIG. 4 shows an integrally cast mounting plate portion 70 with openings 70 to receive fasteners.

The cast single-piece end cap body 16 provides a more structurally sound and more durable component than prior art stamped modules. Casting the single-piece end cap body 16 as a single-piece component increases the durability of the end cap mounting module because multiple weld joint interfaces have been eliminated. Further, costs can be more tightly controlled for such a cast component. Additionally, the casting provides smooth contours that are resistive to debris collection. Further, strength in the mounting area is improved such that a pedestal type mount configuration can be utilized without a stanchion.

The casting also has improved sound characteristics when compared to prior stamped configurations. Using a casting increases a resonant frequency of the component to range that is typically outside the operation of the engine/vehicle. Further, the casting offers a dynamic stiffness that raises the natural frequency of the component itself.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. An end cap mounting module comprising:

a single-piece end cap body having a first mount interface for connection to a vehicle exhaust component and a second mount interface for connection to an exhaust pipe, said single-piece end cap body comprising an exhaust gas passageway to conduct engine exhaust gases from said first mount interface to said second mount interface; and at least one mounting boss integrally formed with said single-piece end cap body, wherein said at least one mounting boss is configured to attach said single-piece end cap body to a vehicle structure.

2. The end cap mounting module according to claim 1 wherein said single-piece end cap body provides a continuous and uninterrupted surface from said first mount interface to said second mount interface.

3. The end cap mounting module according to claim 1 wherein said single-piece end cap body is comprised of a cast material.

4. The end cap mounting module according to claim 3 wherein said cast material comprises cast iron.

5. The end cap mounting module according to claim 1 including a sensor boss portion integrally formed with said single-piece end cap body.

6. The end cap mounting module according to claim 1 wherein said at least one mounting boss comprises at least one fastener boss that includes a threaded opening for receiving a fastener.

7. The end cap mounting module according to claim 6 wherein the at least one fastener boss comprises a plurality of fastener bosses that are integrally formed with said single-piece end cap body, and wherein the plurality of fastener bosses are configured to attach said single-piece end cap body to a vehicle structure.

8. The end cap mounting module according to claim 1 wherein a sensor boss and at least one fastener boss are integrally cast with said single-piece end cap body as a single-piece casting.

9. The end cap mounting module according to claim 1 wherein said single-piece end cap body comprises a bottom surface with a circumferential wall portion extending outwardly about a periphery of said bottom surface, and with said first mount interface comprising an opening to the vehicle exhaust component.

10. The end cap mounting module according to claim 9 wherein said circumferential wall portion terminates at said opening to the vehicle exhaust component.

11. The end cap mounting module according to claim 10 wherein said single-piece end cap body includes a tubular portion extending outwardly from an outer surface of said circumferential wall portion, said tubular portion terminating at said second mounting interface.

12. The end cap mounting module according to claim 11 wherein said opening defines a first center axis and wherein said second mounting interface comprises another opening that defines a second center axis, and wherein said first and said second center axes are perpendicular to each other.

13. The end cap mounting module according to claim 1 wherein said first mount interface comprises a catalytic converter mount interface adapted to connect to the vehicle exhaust component that comprises a catalytic converter, and said second mount interface comprises an exhaust pipe mount interface adapted to connect to the exhaust pipe, and wherein said end cap body includes an internal cavity that defines the exhaust gas passageway to conduct high temperature exhaust gases between said catalytic converter mount interface and said exhaust pipe mount interface.

14. The end cap mounting module according to claim 1 including a heat shield mounted within an internal cavity formed within said end cap body.

15. A method of forming an end cap mounting module comprising the steps of:

casting a vehicle exhaust system end cap body as a single-piece component that has a first mount interface for connection to a vehicle exhaust component and a second mount interface for connection to an exhaust pipe such that the end cap body comprises an exhaust gas passageway to conduct engine exhaust gas from the first mount interface to the second mount interface.

16. The method according to claim 15 including casting the end cap body from a cast iron material.

17. The method according to claim 15 including integrally casting a sensor boss to the end cap body as part of the single-piece component.

18. The method according to claim 15 including integrally casting at least one fastener boss to the end cap body as part of the single-piece component.

19. The method according to claim 18 including casting the single-piece component to have an outer wall that surrounds a center axis to define an internal open area, and wherein the step of integrally casting the at least one fastener boss to the end cap body as part of the single-piece component further comprises casting a plurality of fastener bosses that are circumferentially spaced apart from each other about the center axis, and wherein the plurality of fastener bosses are configured to attach the single-piece component to a vehicle structure.

20. The method according to claim 15 wherein the first mount interface comprises a catalytic converter mount interface adapted to connect to the vehicle exhaust component that comprises a catalytic converter, and the second mount interface comprises an exhaust pipe mount interface adapted to connect to the exhaust pipe, and including forming the end cap body with an internal cavity that defines the exhaust gas passageway to conduct high temperature engine exhaust gases between the catalytic converter mount interface and the exhaust pipe mount interface.

21. The method according to claim 15 including installing a heat shield within an internal cavity formed in the end cap body.

22. An end cap mounting module comprising:

a single-piece end cap body having a first exhaust component mount interface adapted for connection to a first exhaust component and a second exhaust component mount interface adapted for connection to a second exhaust component, and wherein said end cap body includes an internal cavity that defines an exhaust gas pathway to conduct high temperature engine exhaust gases between the first exhaust component mount interface and the second exhaust component mount interface; and at least one mounting boss integrally formed with the single-piece end cap body, wherein the at least one mounting boss is configured to attach the single-piece end cap body to a vehicle structure.

23. The end cap mounting module according to claim 22 wherein said first exhaust component mount interface comprises a catalytic converter mount interface.

24. The end cap mounting module according to claim 23 wherein said single-piece end cap body comprises an enclosed bottom surface with a circumferential wall portion extending outwardly about a periphery of said bottom surface, and wherein said catalytic converter mount interface comprises an opening to a catalytic converter at a termination of said circumferential wall portion and said second exhaust component mount interface comprises an opening formed at a termination of a tubular portion formed to extend outwardly from an outer surface of said circumferential wall portion.

25. The end cap mounting module according to claim 22 including a heat shield mounted within said internal cavity.

26. The end cap mounting module according to claim 22 wherein the said single-piece end cap body comprises an outer wall that surrounds a center axis to define an internal open area, and wherein said at least one mounting boss comprises a plurality of mounting bosses that are circumferentially spaced apart from each other about the center axis.

27. The end cap mounting module according to claim 22 wherein the at least one mounting boss includes an aperture configured to receive a fastener.

28. The end cap mounting module according to claim 22 wherein said single-piece end cap body is comprised of a cast material.

29. An end cap mounting module for a vehicle exhaust system comprising:

a single-piece body having an outer wall surrounding a center axis to define an internal open area;

a first mount interface on said single-piece body that is adapted to connect said single-piece body to a first vehicle exhaust component;

a second mount interface on said single-piece body that is adapted to connect said single-piece body to a second vehicle exhaust component; and wherein said single-piece body includes at least one integrally formed mounting boss configured to attach said single-piece body to a vehicle structure.

30. The end cap mounting module according to claim 29 wherein said at least one integrally formed mounting boss comprises a plurality of integrally formed mounting bosses that are circumferentially spaced apart from each other about the center axis.

31. The end cap mounting module according to claim 30 wherein each mounting boss includes an aperture configured to receive a fastener.

32. The end cap mounting module according to claim 30 wherein said single-piece body is comprised of a cast material.

33. The end cap mounting module according to claim 29 including a heat shield positioned adjacent to said outer wall.

34. The end cap mounting module according to claim 29 wherein at least one of the first and second vehicle exhaust components is configured to operate within the vehicle exhaust system which conducts high temperature exhaust gases from an engine.

* * * * *